United States Patent [19]

Reeves

[11] 4,435,499

[45] Mar. 6, 1984

[54] PHOTOTHERMOGRAPHIC SILVER HALIDE MATERIAL AND PROCESS

[75] Inventor: John W. Reeves, Rochester, N.Y.

[73] Assignee: Eastman Kodak Company, Rochester, N.Y.

[21] Appl. No.: 462,506

[22] Filed: Jan. 31, 1983

[51] Int. Cl.[3] ..... G03C 5/16; G03C 1/02

[52] U.S. Cl. ..... 430/350; 430/348; 430/353; 430/495; 430/566; 430/619; 430/620; 430/964

[58] Field of Search ..... 430/348, 350, 353, 619, 430/620, 495, 566, 964

[56] References Cited

U.S. PATENT DOCUMENTS

| | | | |
|---|---|---|---|
| 3,984,871 | 7/1975 | Land | 96/3 |
| 4,063,951 | 12/1977 | Bogg | 96/94 |
| 4,067,739 | 1/1978 | Lewis | 96/94 |
| 4,150,994 | 4/1979 | Maternaghan | 96/94 |
| 4,184,877 | 1/1980 | Maternaghan | 430/567 |
| 4,184,878 | 1/1980 | Maternaghan | 430/567 |
| 4,264,725 | 4/1981 | Reeves | 430/619 |

OTHER PUBLICATIONS

*Research Disclosure,* vol. 170, Jun. 1978, Item No. 17029.

*Making and Coating Photographic Emulsions* by Zelikman and Levi, Focal Press, 1964, p. 223.

de Cugnac and Chateau, "Evolution of the Morphology . . . ", *Science et Industries Photographiques,* vol. 33, No. 2, 1962, pp. 121–125.

Duffin, *Photographic Emulsion Chemistry,* Focal Press, 1966, pp. 66–72.

*Research Disclosure,* Jan. 1983, Item No. 22534.

*Science et Industries Photographiques,* vol. 34, May–Jun., 1963, pp. 141–150.

*Primary Examiner*—Mary F. Downey

*Attorney, Agent, or Firm*—Richard E. Knapp

[57] ABSTRACT

Photosensitive silver halide grains that are thin tabular grains having an average grain thickness of less than 0.3 microns provide advantages, including improved spectral sensitization and image tone, in a photothermographic material comprising photosensitive silver halide and a photosensitive silver halide processing agent. An image is developed in such an exposed photothermographic material by heating the material, such as to a temperature within the range of about 90° C. to about 180° C.

49 Claims, No Drawings

PHOTOTHERMOGRAPHIC SILVER HALIDE MATERIAL AND PROCESS

FIELD OF THE INVENTION

This invention relates to photothermographic silver halide materials comprising photosensitive silver halide grains that are thin tabular grains. It also relates to development of an image in such an exposed photothermographic material.

BACKGROUND OF THE INVENTION

Photothermographic materials are well known in the photographic art. Photothermographic materials are also known as heat developable photographic materials. The photothermographic materials after imagewise exposure are heated to moderately elevated temperatures to produce a developed image without the need for processing solutions or baths. The heat development provides a developed silver image.

An example of a known photothermographic silver halide material comprises (a) photosensitive silver halide, prepared either in situ or ex situ, (b) an image forming combination comprising (i) an organic heavy metal salt oxidizing agent, generally a silver salt of a long chain fatty acid, such as silver behenate or silver strearate, with (ii) a reducing agent for the organic heavy metal salt oxidizing agent, such as a phenolic reducing agent, and, (c), generally a binder, such as poly(vinyl butyral). Such a photothermographic material is described in, for example, *Research Disclosure*, Vol. 170, June, 1978, Item No. 17029 and U.S. Pat. No. 4,264,725. It has been desirable to have photosensitive silver halide grains prepared ex situ in such a photothermographic material because silver halide has high photosensitivity and due to the ease of control in preparation of silver halide based on conventional aqueous silver halide gelatino emulsion technology. It has also been desirable to provide increased development efficiency, increased photographic speed, increased maximum density and more neutral tone developed images without the need for further addenda in such photothermographic materials containing photosensitive silver halide prepared ex situ. Adding conventionally prepared cubic grain silver halide gelatino photographic emulsions has not provided an answer to these problems as illustrated in the following comparative examples. No answer to these problems has been clear from the photothermographic art.

SUMMARY OF THE INVENTION

It has been found that improvements, such as improved development efficiency, increased photographic speed, increased maximum density and improved developed image tone, are provided in a photothermographic material comprising photosensitive silver halide grains wherein at least 50% of the projected area of the photosensitive silver halide grains is provided by thin tabular grains having an average grain thickness of less than 0.3 microns, preferably less than 0.2 microns, optionally within the range of about 0.03 to about 0.08 microns. The thin tabular silver halide grains preferably have an average aspect ratio of at least 5:1, such as within the range of 5:1 to 15:1. The photothermographic material comprises a photosensitive silver halide processing agent, which, after imagewise exposure of the photothermographic silver halide material, enables development of an image upon heating of the photothermographic silver halide material. The photosensitive silver halide tabular grains are especially advantageous when spectrally sensitized.

A preferred photothermographic material comprises, in reactive association, (a) photosensitive silver halide grains wherein at least 50% of the projected area of the photosensitive silver halide grains is provided by thin tabular grains having an average grain thickness of less than 0.3 microns, and (b) an image forming combination comprising (i) an organic heavy metal salt oxidizing agent, such as a silver salt of a long chain fatty acid, with (ii) a reducing agent for the organic heavy metal salt oxidizing agent, such as a phenolic reducing agent. The photothermographic material preferably comprises a binder, such as a poly(vinyl butyral) binder.

An image is developed in the photothermographic material after exposure by merely heating the photothermographic material to moderately elevated temperatures, such as temperatures within the range of about 90° C. to about 180° C.

DETAILED DESCRIPTION OF THE INVENTION

Photosensitive tabular silver halide grains herein mean that the photosensitive silver halide grains have two substantially parallel crystal faces, each of which is substantially larger than any other single crystal face of the grain. The term "substantially parallel" herein includes surfaces that appear parallel on inspection at or above 40,000 times magnification.

The term thin herein regarding tabular silver halide grains means that the grains have an average grain thickness of less than 0.3 microns, preferably less than 0.2 microns, optimally within the range of about 0.03 to about 0.08 microns.

The aspect ratio of the tabular silver halide grains herein means the ratio of diameter to thickness of the silver halide grains. The tabular silver halide grains in a photothermographic silver halide material preferably have an average aspect ratio of at least 5:1. As indicated infra, thin tabular grains having aspect ratios of 200:1, 100:1 or higher can be prepared and are useful in this invention. However, since tabular grains tend to increase in thickness as they increase in aspect ratio, tabular grains in the optimum thickness range useful in this invention typically have an average aspect ratio within the range of 5:1 to 15:1. In a preferred form of the invention at least 70%, such as at least 90%, of the total projected area of the silver halide grains in the photothermographic silver halide material is provided by thin tabular grains having an average aspect ratio of at least 5:1.

The grain characteristics of the silver halide tabular grains are readily ascertained by procedures well known to those skilled in the art. The term "aspect ratio" herein means the ratio of the diameter of the grain to its thickness. The "diameter" of the grain in turn means the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.3 micron. From this the aspect ratio of each such thin tabular grain can be calculated, and the aspect ratios of all the thin tabular grains in the sample can be averaged to obtain their average aspect ratio. By this definition the average aspect ratio is the average of individual thin tabular grain aspect ratios. In practice it is generally simpler to obtain an average thickness of an average diameter of the thin tabular grains and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the thin tabular silver halide grains can be summed, the projected areas of the remaining silver halide grains in the photomicrograph can be summed separately, and from the two sums the percentage of the total projected area of the thin tabular silver halide grains can be calculated.

In the above determinations a reference tabular grain thickness of less than 0.3 micron was chosen to distinguish the uniquely thin tabular grains herein contemplated from thicker tabular grains. At lower diameters it is not always possible to distinguish tabular and nontabular grains in micrographs. Thin tabular grains for purposes of this disclosure are those silver halide grains which are less than 0.3 micron in thickness and appear tabular at 40,000 times magnification. The term "projected area" is used in the same sense as the terms "projection area" and "projective area" commonly employed in the art. See, for example, James and Higgins, *Fundamentals of Photographic Theory,* Morgan and Morgan, New York, p. 15.

Although only one layer comprising thin tabular photosensitive silver halide grains is required in a photothermographic element of this invention, photothermographic elements can, if desired, contain a plurality of such layers. It is additionally contemplated to employ thin tabular grain emulsion layers in combination with thicker high aspect ratio tabular grain emulsion layers, such as those having average tabular grain thicknesses up to 0.5 micron or with conventional three dimensional emulsions.

Thin tabular silver bromoiodide grains are prepared by procedures described in, for example, Wilgus and Haefner, U.S. Ser. No. 429,420, filed Sept. 30, 1982, and commonly assigned, titled "High Aspect Ratio Silver Bromoiodide Emulsions And Processes For Their Preparation", which is a continuation-in-part of U.S. Ser. No. 320,905, filed Nov. 12, 1981, the disclosures of which are incorporated herein by reference.

Thin tabular grain silver bromoiodide emulsions can be prepared by a precipitation process similar to that which forms a part of the Wilgus and Haefner invention as follows: Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by U.S. Pat. No. 4,334,012, here incorporated by reference, the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants. When a peptizer is initially present, it is preferably present in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. The term "substantially free of iodide ions" as applied to the contents of the reaction vessel herein means that insufficient iodide ions are present as compared to bromide ions to precipitate as a separate silver iodide phase. It is preferred to maintain the iodide concentration in the reaction vessel prior to silver salt introduction at less than 0.5 mole percent of the total halide ion concentration present.

If the pBr of the dispersing medium is initially too high, the tabular silver bromoiodide grains produced will be comparatively thick and therefore of low aspect ratios. It is contemplated to maintain the pBr of the reaction vessel initially at or below 1.6. (If average tabular grain thicknesses of less than 0.2 micron are desired, the pBr value should be maintained below 1.5.) On the other hand, if the pBr is too low, the formation of nontabular silver bromoiodide grains is favored. Therefore, it is contemplated to maintain the pBr of the reaction vessel at or above 0.6. (pBr is defined as the negative logarithm of bromide ion concentration. Both pH and pAg are similarly defined for hydrogen and silver ion concentrations, respectively.)

During precipitation silver, bromide, and iodide salts are added to the reaction vessel by techniques well known in the precipitation of silver bromoiodide grains. An aqueous silver salt solution of a soluble silver salt, such as silver nitrate, is generally introduced into the reaction vessel concurrently with the introduction of the bromide and iodide salts. The bromide and iodide salts are also generally introduced as aqueous salt solutions, such as aqueous solutions of one or more soluble ammonium, alkali metal such as sodium or potassium, or alkaline earth metal such as magnesium or calcium halide salts. The silver salt is at least initially introduced into the reaction vessel separately from the iodide salt. The iodide and bromide salts are added to the reaction vessel separately or as a mixture.

With the introduction of silver salt into the reaction vessel the nucleation stage of grain formation is initiated. A population of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation.

The aspect ratios of the tabular grains formed are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.5. It is preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing thin tabular silver bromoiodide grains.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. Since bromide and/or iodide are precipitated in preference to chloride, it is also possible to employ silver chlorobromide and silver chlorobromoiodide grains. The silver halide grains are preferably very fine such as less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.1 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored. By avoiding the formation of additional grain nuclei after passing into the growth stage of precipitation, relatively monodispersed thin tabular silver bromoiodide grain populations are obtained. Emulsions having coefficients of variation of less than about 30 percent can be prepared. The coefficient of variation herein is defined as 100 times the standard deviation of the grain diameter divided by the average grain diameter. By intentionally favoring renucleation during the growth stage of precipitation, it is possible to produce polydispersed emulsions of substantially higher coefficients of variation.

The concentration of iodide in the silver bromoiodide emulsions can be controlled by the introduction of iodide salts. Any conventional iodide concentration is useful. Except as otherwise indicated, all references to halide percentages are based on silver present in the corresponding emulsion, grain, or grain region being discussed; for instance, a grain consisting of silver bromoiodide containing 40 mole percent iodide also contains 60 mole percent bromide. In one preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures, for example, about 30° C. It is generally preferred that precipitation be undertaken at temperatures in the range of from 40° to 80° C.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Advantages in photographic speed and/or granularity can result from increasing the proportion of iodide in laterally displaced, preferably annular, regions of tabular grain silver bromoiodide emulsions as compared to central regions of the tabular grains. Iodide concentrations are advantageous in the central regions of tabular grains of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. The thin tabular silver bromoiodide grains useful in photothermographic materials can exhibit substantially uniform or graded iodide concentration profiles and the gradation can be controlled, as desired, to favor higher iodide concentrations internally or at or near the surfaces of the tabular silver bromoiodide grains.

Although the preparation of the thin tabular grain silver bromoiodide emulsions has been described by reference to the process of Wilgus and Haefner, which produces neutral or nonammoniacal emulsions, the emulsions of the present invention are not limited by any particular process for their preparation.

Thin, high and intermediate aspect ratio tabular grain silver bromide emulsions lacking iodide can be prepared by the process described above similar to the process of Wilgus and Haefner further modified to exclude iodide. Thin tabular silver bromide emulsions containing square and rectangular grains can be prepared similarly as taught by Mignot U.S. Ser. No. 320,912, filed Nov. 11, 1981, commonly assigned, titled "Silver Bromide Emulsions of Narrow Grain Size Distribution and Processes for Their Preparation", the disclosure of which is incorporated by reference. In this process cubic seed grains having an edge length of less than 0.15 micron are present. While maintaining the pAg of the seed grain emulsion in the range of from 5.0 to 8.0, the emulsion is ripened in the substantial absence of nonhalide silver ion complexing agents to produce tabular silver bromide grains having the desired average aspect ratio.

Thin tabular grain silver bromide emulsions lacking iodide are also useful.

The thin tabular silver bromide or bromoiodide grains are preferably alternatively prepared by a double jet precipitation technique at a controlled pBr. An illustrative preparation of a preferred tabular grain silver bromoiodide emulsion (herein designated as Emulsion A) is as follows: 1.4 liters of an aqueous bone gelatin (2.16% by weight) solution containing 0.168 molar potassium bromide is placed in a precipitation vessel and stirred at 50° C. To this solution is added by a double jet technique a 2.0 molar silver nitrate aqueous solution and a 2.0 molar potassium bromoiodide (3.0 mole percent iodide) aqueous solution at a constant flow rate for six minutes at controlled pBr of about 0.77 at 50° C. 2.5 Moles of silver were used in preparing the emulsion. Following precipitation the emulsion was cooled to about 40° C., 0.4 liter of a phthalated gelatin (8.25 percent by weight) aqueous solution was added, and the resulting emulsion was washed two times by a coagulation process, such as described in U.S. Pat. No. 2,614,928.

Other thin tabular grain silver halide emulsions can be prepared merely by terminating precipitation when the desired average aspect ratios are achieved. For example, a process is useful for preparing tabular grains of at least 50 mole percent chloride having opposed crystal faces lying in {111} crystal planes and at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an aminoazaindene and a peptizer having a thioether linkage.

Another illustrative tabular grain emulsion is one in which the silver halide grains contain chloride and bromide in at least annular grain regions and preferably throughout. The tabular grain regions containing silver chloride and bromide are formed by maintaining a molar ratio of chloride and bromide ions of from 1.6:1 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by U.S. Pat. Nos. 1,195,432; 1,951,933; 2,448,060; 2,628,167; 2,950,972; 3,488,709; 3,737,313; 3,772,031; 4,269,927; and *Research Disclosure,* Vol. 134, June 1975, Item 13452. *Research Disclosure* and its predecessor, *Product Licensing Index,* are publications of Industrial Opportunities Ltd.; Homewell, Havant; Hampshire, PO9 1EF, United Kingdom. The tabular grain emulsions can be internally reduction sensitized during precipitation, as illustrated by Moisar et al, *Journal of Photographic Science,* Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by U.S. Pat. Nos. 3,821,002; 3,031,304 and Claes et al, *Photographische Korrespondenz,* Band 102, Number 10, 1967, p. 162. In order to obtain rapid distribution of the reactants within the reaction vessel, specially constructed mixing devices can be employed, as illustrated by U.S. Pat. Nos. 2,996,287; 3,342,605; 3,415,650; 3,785,777; 4,147,551; 4,171,224; U.K. patent application No. 2,022,431A; German OLS Nos. 2,555,364 and 2,556,885; and *Research Disclosure,* Volume 166, February 1978, Item 16662.

In forming the tabular grain emulsions peptizer concentrations of from 0.2 to about 10 percent by weight, based on the total weight of emulsion components in the reaction vessel, can be employed; it is preferred to keep the concentration of the peptizer in the reaction vessel prior to and during silver bromoiodide formation below about 6 percent by weight, based on the total weight. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide.

It is specifically contemplated that grain ripening can occur during the preparation of silver halide emulsions, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents are useful and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions exhibiting the highest realized speed-granularity relationships.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide, based on the weight of silver. Illustrative prior teachings of employing thiocyanate ripening agents are found in U.S. Pat. Nos. 2,222,264, cited above; 2,448,534 and 3,320,069; the disclosures of which are here incorporated by reference. Alternatively, conventional thioether ripening agents, such as those disclosed in U.S. Pat. Nos. 3,271,157; 3,574,628; and 3,737,313, here incorporated by reference, can be employed.

The thin tabular grain emulsions are preferably washed to remove soluble salts. The soluble salts can be removed by decantation, filtration, and/or chill setting and leaching, as illustrated by U.S. Pat. Nos. 2,316,845 and 3,396,027; by coagulation washing, as illustrated by U.S. Pat. Nos. 2,618,556; 2,614,928; 2,565,418; 3,241,969; 2,489,341; U.K. Pat. Nos. 1,305,409 and 1,167,159; by centrifugation and decantation of a coagulated emulsion, as illustrated by U.S. Pat. Nos. 2,463,794; 3,707,378; 2,996,287 and 3,498,454; by employing hydrocyclones alone or in combination with centrifuges, as illustrated by U.K. Pat. Nos. 1,336,692; 1,356,573 and *Soviet Chemical Industry*, Vol. 6, No. 3, 1974, pp. 181–185; by diafiltration with a semipermeable membrane, as illustrated by *Research Disclosure*, Vol. 102, October 1972, Item 10208; *Research Disclosure*, Vol. 131, March 1975, Item 13122; *Research Disclosure*, Vol. 135, July 1975, Item 13577; German OLS No. 2,436,461; U.S. Pat. Nos. 2,495,918; and 4,334,012, cited above, or by employing an ion exchange resin, as illustrated by U.S. Pat. Nos. 3,782,953 and 2,827,428. The emulsions, with or without sensitizers, can be dried and stored prior to use as illustrated by *Research Disclosure*, Vol. 101, September 1972, Item 10152. Washing is particularly advantageous in terminating ripening of the tabular grains after the completion of precipitation to avoid increasing their thickness and reducing their aspect ratio.

The thin tabular grain emulsions can have extremely high average aspect ratios. Tabular grain average aspect ratios can be increased by increasing average grain diameters. Tabular grain average aspect ratios can also or alternatively be increased by decreasing average grain thicknesses. When silver coverages are held constant, decreasing the thickness of tabular grains can improve speed/grain position as a direct function of increasing aspect ratio. Hence the maximum average aspect ratios of the tabular grain emulsions are a function of the maximum average grain diameters acceptable for the specific photothermographic material and the minimum attainable tabular grain thicknesses which can be produced. Maximum average aspect ratios have been observed to vary, depending upon the precipitation technique employed and the tabular grain halide composition. The highest observed average aspect ratios, 500:1, for tubular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromide and/or iodide, can be prepared. It is contemplated that in all instances the average diameter of the thin tabular grains will be less than 30 microns, preferably less than 15 microns.

Thin tabular grain photosensitive silver halides are useful in photothermographic materials intended to form negative or positive images. For example, the photothermographic materials can be of a type whch form either surface or internal latent images on exposure and which produce negative images upon heating. Alternatively, the photothermographic materials can be of a type that produce direct positive images in response to a single heating step. When the tabular and other imaging silver halide grains present in the photothermographic material are intended to form direct positive images, they can be surface fogged and employed in combination with an organic electron acceptor. The organic electron acceptor can be employed in combination with a spectrally sensitizing dye or can itself be a spectrally sensitizing dye. If internally sensitive emulsions are employed, surface fogging and organic electron acceptors can be employed in combination, but neither surface fogging nor organic electron acceptors are required to produce direct positive images. Direct positive images can be formed by development of internally sensitive emulsions in the presence of nucleating agents, which can be contained in the photothermographic element. Preferred nucleating agents are those adsorbed directly to the surfaces of the silver halide grains. Evans, Daubendiek, and Raleigh U.S. Ser. No. 431,912, titled DIRECT REVERSAL EMULSIONS AND PHOTOGRAPHIC ELEMENTS USEFUL IN IMAGE TRANSFER FILM UNITS, filed Sept. 30, 1982 and commonly assigned, which is a continuation-in-part of U.S. Ser. No. 320,891, filed Nov. 12, 1981, both here incorporated by reference, discloses internal latent image-forming high aspect ratio thin tabular grain emulsions containing nucleating agents. Similar emulsions, but containing thin tabular grains of lower aspect ratios, are also useful in the practice of this invention.

The thin tabular grain silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include, joined by a double bond or methine linkage, a basic heterocyclic nucleus of the cyanine dye type and an acidic nucleus, such as can be derived from barbituric acid, 2-thiobarbituric acid, rhodanine, hydantoin, 2thiohydantoin, 4-thiohydantoin, 2-pyrazolin-5-one, 1-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes are useful. Dyes with sensitizing maxima at wavelengths throughout the visible spectrum and with a great variety of spectral sensitivity curve shapes are known. The choice and relative proportions of dyes depends upon the region and the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes are useful which result in supersensitization—that is, spectral sensitization that is greater in some spectral region than that from any concentration of one of the dyes alone or that which would result from the additive effect of the dyes. Supersensitization is achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418–430.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes.

Useful blue spectral sensitizing dyes for thin tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics. There are, however, general structural correlations that can serve as a guide in selecting useful blue sensitizers. Generally the shorter the methine chain, the shorter the wavelength of the senitizing maximum. Nuclei also influence absorption. The addition of fused rings to nuclei tends to favor longer wavelengths of absorption. Substituents can also alter absorption characteristics.

Among useful spectral sensitizing dyes for sensitizing silver halide emulsions are those found in U.K. Pat. No. 742,112, U.S. Pat. Nos. 1,846,300; '301, '302; '303; '304; 2,078,233 and 2,089,729, 2,165,338; 2,213,238; 2,231,658; 2,493,747; '748; 2,526,632; 2,739,964 (Reissue 24,292); 2,778,823; 2,917,516; 3,352,857; 3,411,916 and 3,431,111; 2,295,276; 2,481,698 and 2,503,776; 2,688,545 and 2,704,714; 2,921,067; 2,945,763; 3,282,933; 3,397,060; 3,660,102; 3,660,103; 3,335,010, 3,352,680 and 3,384,486; 3,397,981; 3,482,978 and 3,623,881; 3,718,470 and 4,025,349. Examples of useful dye combinations, including supersensitizing dye combinations, are found in U.S. Pat. Nos. 3,506,443 and 3,672,898. As examples of supersensitizing combinations of spectral sensitizing dyes and nonlight absorbing addenda, it is specifically contemplated to employ thiocyanates during spectral sensitization, as taught by U.S. Pat. No. 2,221,805; bistriazinylaminostilbenes, as taught by U.S. Pat. No. 2,933,390; sulfonated aromatic compounds, as taught by U.S. Pat. No. 2,937,089; mercapto-substituted heterocycles, as taught by U.S. Pat. No. 3,457,078; iodide, as taught by U.K Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or thick tabular silver halide grains. To realize the full advantages of thin tabular grain emulsions it is preferred to adsorb spectral sensitizing dye to the tabular grain surfaces in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol 56, p. 1065, 1952; Spence et al, "Desensitization of Sensitizing Dyes", *Journal of Physical and Colloid Chemistry*, Vol. 56, No. 6, June 1948, pp. 1090–1103; and U.S. Pat. No. 3,979,213.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by U.S. Pat. Nos. 3,628,960 and 4,225,666. Introduction of the spectral sensitizing dye into the emulsion can be distributed so that a portion of the spectral sensitizing dye is present prior to chemical sensitization and a remaining portion is introduced after chemical sensitization. The spectral sensitizing dye can be alternatively added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

The preferred chemical sensitizers for the highest attained speed-granularity relationships are gold and sulfur sensitizers, gold and selenium sensitizers, and gold, sulfur, and selenium sensitizers. Thus, in a preferred form of the invention, thin tabular grain silver bromide or, most preferably, silver bromoiodide emulsions contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washing techniques. In various of the preferred forms indicated above the tabular silver bromide or silver bromoiodide grains can have another silver salt at their surface, such as silver thiocyanate or another silver halide of differing halide content such as silver chloride or silver bromide, although the other silver salt may be present below detectable levels.

A preferred embodiment of the invention comprises a photothermographic material designed for dry chemical development or designed for dry physical development comprising a thin tabular grain photosensitive silver halide having an average grain thickness of less than 0.3 microns. Photothermographic materials in which thin tabular grain photographic silver halides are useful, such as in combination with or in place of photographic silver halide grains that are not thin tabular grains, are described in, for example, *Research Disclosure,* Vol. 170, June, 1978, Item No. 17029, the disclosure of which is incorporated herein by reference. A preferred photothermographic material according to the invention can be prepared, for example, by very thoroughly mixing, such as by ultrasonic wave mixing, (I) a hydrophilic photosensitive silver halide emulsion wherein at least 50% of the projected area of the photosensitive silver halide grains in the emulsion is provided by thin tabular photosensitive silver halide grains having an average grain thickness of less than 0.3 microns with (II) an organic solvent mixture comprising (A) an alcohol photographic speed-increasing solvent with (B) an aromatic hydrocarbon solvent that is compatible with the alcohol solvent and (C) 0 to 10%, preferably about 3 to about 8%, by weight of said organic solvent mixture of a hydrophobic binder, such as poly(vinyl butyral) and then very thoroughly mixing the resulting product with (III) comprising (a) a hydrophobic binder and (b) an oxidation-reduction image-forming composition comprising (i) a silver salt of a long-chain fatty acid with (ii) an organic reducing agent, typically in an organic solvent. An illustrative organic solvent mixture for such a photothermographic material is described in, for example, U.S. Pat. No. 4,264,725, the description of which is incorporated herein by reference.

A variety of alcohol photographic speed-increasing solvents are useful in the described solvent mixture. It is necessary that the described alcohol solvent be compatible with the described aromatic hydrocarbon solvent and the other components in the photothermographic silver halide composition. Some alcohol solvents can be insufficiently compatible with the described composition to be useful, such as chloro, hydroxy and nitro subsituted benzyl alcohols. Selection of an optimum alcohol solvent will depend upon such factors as the particular components of the photothermographic composition, the desired image, coating conditions, the particular aromatic hydrocarbon solvent, the particular photographic silver halide emulsion, and the concentration of the various components of the photothermographic composition. Combinations of alcohol solvents are useful. Selection of an optimum alcohol solvent can be carried out by a simple test in which the alcohol solvent is used in Example 1 in place of benzyl alcohol. If the results of the alcohol solvent selected are similar to those of Example 1, the alcohol solvent is considered to be at least satisfactory. The described alcohol photographic speed-increasing solvents can be selected from, for example, phenalkylols and phenoxyalkylols, in which the alkylol contains 1 to 4 carbon atoms, and in which the phenyl group is unsubstituted or substituted with lower alkyl, such as alkyl containing 1 to 4 carbon atoms, lower alkoxy, such as alkoxy containing 1 to 4 carbon atoms, fluorosubstituted lower alkyl or phenoxy.

The term "speed-increasing" with regard to the speed-increasing solvent herein means that the alcohol solvent provides a higher relative speed compared to a similar photothermographic composition containing no alcohol solvent.

The described benzyl alcohol solvent can be unsubstituted benzyl alcohol or can be benzyl alcohol which is substituted with a group which does not adversely affect the desired solvent or sensitometric properties produced by the benzyl alcohol derivative. Examples of substitutents which do not adversely affect the desired properties include methyl, phenoxy, trifluoromethyl, methoxy and ethoxy. Unsubstituted benzyl alcohol is preferred.

A variety of aromatic hydrocarbon solvents are useful in the described solvent mixture with the described alcohol speed-increasing solvent. The aromatic hydrocarbon solvent must be compatible with the alcohol solvent and other components of the photothermographic composition without adversely affecting the desired solvent and sensitometric properties produced by the solvent mixture. The optimum aromatic hydrocarbon solvent can be selected based on such factors as the particular components of the photothermographic composition, the particular alcohol solvent, coating conditions for the photothermographic composition, the particular photosensitive silver halide emulsion and the like. Combinations of aromatic hydrocarbon solvents are useful.

Examples of useful aromatic hydrocarbon solvents include toluene, xylene and benzene. Toluene is preferred as a solvent with benzyl alcohol.

Other solvents that are useful in place of or in combination with the described aromatic hydrocarbon solvents include butyl acetate, dimethyl acetamide and dimethylformamide. These solvents are useful alone or in combination. However, an aromatic hydrocarbon solvent, such as toluene, is preferred with the described alcohol solvent, such as benzyl alcohol.

A range of concentration of described alcohol solvent is useful in the described photothermographic silver halide composition. The alcohol solvent is useful at a concentration which produces a photothermographic element as coated containing the alcohol within the range of about 0.50 grams/$m^2$ to about 8.00 grams/$m^2$. A preferred concentration of alcohol solvent, such as benzyl alcohol, is within the range of about 0.50 grams to about 1.50 grams of alcohol solvent/$m^2$ of support of the described photothermographic element. The optimum concentration of alcohol solvent will depend upon the particular components of the photothermographic material, coating conditions, desired image, the particular aromatic hydrocarbon solvent, the particular alcohol solvent and the like.

A range of concentration of aromatic hydrocarbon solvent is useful in the described photothermographic silver halide composition. The concentration of aromatic hydrocarbon solvent is typically within the range of 30% to about 80% by weight of total photothermographic composition. A preferred concentration of aromatic hydrocarbon solvent, such as toluene, is within the range of about 45% to about 70% by weight of total photothermographic composition. The optimum concentration of aromatic hydrocarbon solvent will depend upon the described factors that relate to selection of the optimum concentration of described alcohol solvent.

A range of ratios of described alcohol solvent to aromatic hydrocarbon solvent is useful in the described solvent mixture at the time of mixing the solvent mixture with the silver halide. The photothermographic silver halide composition capable of being coated on a support according to the invention generally comprises a concentration of the alcohol photographic speed increasing solvent that is within the range of about 0.25 mole to about 2.0 moles of the alcohol solvent per mole of photosensitive silver halide in the emulsion. The ratio of alcohol solvent to aromatic hydrocarbon solvent at this point is within the range of about 1:4 to about 1:30. A preferred ratio of described alcohol solvent to aromatic hydrocarbon solvent is within the range of about 1:10 to about 1:25. An optimum ratio of alcohol solvent to aromatic hydrocarbon solvent will depend upon such factors as the particular solvents, the specific components of the photothermographic silver halide composition, coating conditions, the desired image, and the particular silver halide emulsion.

In the described photothermographic composition, that is prior to coating onto a suitable support, the ratio of alcohol solvent to hydrocarbon solvent generally is within the range of about 1:50 to 1:200 with a preferred range of 1:75 to 1:150.

The concentration of water in the photothermographic silver halide composition, as coated, should be no more than that which can be accommodated by the concentration of alcohol speed increasing solvent. The concentration of water in the photothermographic composition is typically no more than about 3% by weight of the composition. It is desirable to concentrate the photothermographic composition prior to coating in order to provide desired coating characteristics.

A hydrophilic photosensitive silver halide emulsion containing thin tabular grain photosensitive silver halide and containing a gelatino peptizer which contains a low concentration of gelatin which is very useful is preferably within the range of about 9 to about 15 grams per mole of silver.

The term "hydrophilic" herein means that the photosensitive silver halide emulsion containing a gelatino peptizer is compatible with an aqueous solvent.

The gelatino peptizer that is useful with the photosensitive silver halide emulsion can comprise a variety of gelatino peptizers known in the photographic art. The gelatino peptizer can be, for example, phthalated gelatin or non-phthalated gelatin. Other gelatino peptizers that are useful include acid or base hydrolyzed gelatins. A non-phthalated gelatin peptizer is preferred.

The photosensitive silver halide emulsion can contain a range of concentration of the gelatino peptizer. The concentration of the gelatino peptizer is generally within the range of about 5 grams to about 20 grams of gelatino peptizer, such as gelatin, per mole of silver in the silver halide emulsion. This is described herein as a low-gel silver halide emulsion. A preferred concentration of gelatino peptizer is within the range of about 9 to about 15 grams of gelatino peptizer per mole of silver in the silver halide emulsion. The optimum concentration of the gelatino peptizer will depend upon such factors as the particular photosensitive silver halide, the desired image, the particular components of the photothermographic composition, coating conditions, the particular solvent combination.

A preferred method for preparation of the photothermographic composition is by a simultaneous double-jet addition of the components into a jacket enclosing an ultrasonic means for exposing the composition to high frequency waves. After combination in the jacket and thorough mixing due to the ultrasonic waves, the mixture can be withdrawn and recirculated through the jacket enclosing the ultrasonic means for additional mixing or withdrawn immediately and combined readily with other addenda to produce the desired photothermographic composition.

A variety of hydrophobic binders are useful in the described photothermographic materials. The binders that are useful include various colloids alone or in combination as vehicles and/or binding agents. Useful hydrophobic binders include transparent or translucent materials. Useful binders include polymers of alkylacrylates and methacrylates, acrylic acid, sulfoalkylacrylates or methacrylates, and those which have crosslinking sites that facilitate hardening or curing. Other useful hydrophobic binders include high molecular weight materials and resins, such as poly(vinyl butyral), cellulose acetate butyrate, poly(methyl methacrylate), poly(styrene), poly(vinyl chloride), chlorinated rubber, poly(isobutylene), butadiene-styrene copolymers, vinyl chloride-vinyl acetate copolymers, copolymers of vinyl acetate, vinyl chloride and maleic anhydride and the like. It is important that the hydrophobic binder not adversely affect the sensitometric or other desired properties of the described photothermographic material. Poly(vinyl butyral) is especially useful. This is available as "BUTVAR", a trademark of and available from The Monsanto Company, U.S.A.

A range of concentration of hydrophobic binder is useful in the photothermographic silver halide materials. The concentration of hydrophobic binder in a photothermographic silver halide composition according to the invention is generally within the range of about 20 to about 65 mg/dm$^2$. An optimum concentration of the described binder varys depending upon such factors as the particular binder, other components of the photothermographic material, coating conditions, desired image, and processing conditions.

If desired, a portion of the photographic silver halide in the photothermographic composition according to the invention can be prepared in situ in the photothermographic material. The phogothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075.

The photothermographic material in a preferred embodiment comprises an oxidation-reduction image-forming combination containing an organic heavy metal salt oxidizing agent, preferably a long-chain fatty acid silver salt with a reducing agent. The oxidation-reduction reaction resulting from this combination upon heating is believed to be catalyzed by the latent image silver from the photosensitive silver halide producing upon imagewise exposure of the photothermographic material followed by overall heating of the photothermographic material. The exact mechanism of image formation is not fully understood.

In photothermographic materials according to the invention preferred organic heavy metal salt oxidizing agents are silver salts. Other useful salts include those that are known to be useful in photothermographic materials designed for dry physical development, such as cobalt and copper salts. Such heavy metal salt oxidizing agents are described in, for example, *Research Disclosure*, Vol. 170, June, 1978, Item No. 17029, the disclosure of which is incorporated herein by reference. Highly preferred silver salt oxidizing agents are silver salts of large chain fatty acids.

A variety of silver salts of long-chain fatty acids are useful in the photothermographic materials according to the invention. The term "long-chain" as used herein is intended to refer to a fatty acid containing 12 to 30 carbon atoms and which is resistant to darkening upon exposure to light. Useful long-chain fatty acid silver salts include, for example, silver stearate, silver behenate, silver caprate, silver hydroxystearate, silver myristate and silver palmitate. A minor proportion of another silver salt oxidizing agent which is not a long-chain fatty acid silver salt can be useful in combination with the silver salt of the long-chain fatty acid if desired. Such silver salts which can be useful in combination with the described silver salts of a long-chain fatty acid include, for example, silver benzotriazole, silver imidazole, silver benzoate and the like. Combinations of silver salts of long-chain fatty acids are useful in the described photothermographic materials.

A variety of organic reducing agents are useful in the photothermographic silver halide materials. These are generally silver halide developing agents which produce the desired oxidation-reduction image-forming reaction upon exposure and heating of the described photothermographic silver halide material. Examples of useful reducing agents include phenolic reducing agents such as polyhydroxybenzenes; and, for instance, 1,1'-bis-(2-hydroxy-4,5-dimethylphenyl)nonane and 2,2'-methylenebis-(6-t-butyl-p-cresol); catechols and pyrogallol; phenylenediamine developing agents; aminophenol developing agents; ascorbic acid developing agents such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-$\beta$-naphthol reducing agents; sulfonamidophenol reducing agents and the like. Combinations of organic reducing agents are useful in the described photothermographic silver halide materials.

A range of concentrations of the organic reducing agent or reducing agent combination are useful in the described photothermographic silver halide materials. The concentration of organic reducing agent or reducing agent combination is preferably within the range of about 5 mg/dm$^2$ to about 20 mg/dm$^2$, such as within the range of about 10 to about 17 mg/dm$^2$. The optimum concentration of organic reducing agent or reducing agent combination will depend upon such factors as the particular long-chain fatty acid, the desired image, processing conditions, the particular solvent mixture, and coating conditions.

The order of addition of the described components for preparing the photothermographic composition before coating the composition onto a support is important to obtain optimum photographic speed, contrast and maximum density. In a preferred method according to the invention the low-gel silver halide emulsion is added to an ultrasonic mixing means through one inlet and a solvent mixture containing toluene, up to about 10%, typically about 3% to about 8%, by weight poly(vinyl butyral) and benzyl alcohol is added through another inlet. The low-gel silver halide is dispersed thoroughly in this environment by ultrasonic waves. The resulting product is then combined with the remaining components of the photothermographic composition.

A variety of mixing means are useful for preparing the described compositions. However, the mixing means should be one which provides very thorough mixing, such as an ultrasonic mixing means. Other mixing means than ultrasonic mixing means that can be useful are commercially available colloid mill mixing means and dispersator mixing means known in the photographic art. A blender, such as a blender known under the trade name of "Waring" blender, does not produce the very thorough mixing that is desired in most cases.

It is generally desirable to have what is described as a toning agent, also known as an activator-toning agent, in the photothermographic material according to the invention. Combinations of toning agents are preferred. Typical toning agents include, for example, phthalimide, phthalic acid, succinimide, N-hydroxphthalimide, N-hydroxy-1,8-naphthalimide, N-hydroxy-1,8-naphthalimide, N-hydroxysuccinimide; 1-(2H)-phthalazinone and phthalazinone derivatives.

Photothermographic materials according to the invention can contain other addenda that are useful in imaging. Useful addenda in the described photothermographic materials include development modifiers that function as speed-increasing compounds, hardeners, antistatic layers, plasticizers and lubricants, coating aids, brighteners, spectral sensitizing dyes, absorbing and filter dyes, matting agents, antifoggants and the like. The photothermographic materials can contain, for example, a pyrrolidinone sensitizer.

A stabilizer is preferred in the described photothermographic material. This can help in stabilization of a developed image. Combinations of stabilizers are also useful. Preferred stabilizers or stabilizer precursors include certain halogen compounds, such as tetrabromobutane and 2-(tribromomethylsulfonyl)benzothiazole, which provide improved post-processing stability and azothioethers and blocked azoline thione stabilizer precursors.

The photothermographic elements according to the invention comprise a variety of supports which can tolerate the processing temperatures useful in developing an image. Illustrative supports include cellulose ester, poly(vinyl acetal), poly(ethylene terephthalate), polycarbonate and polyester film supports. Related film and resinous support materials, as well as paper, glass, metal and the like supports which can withstand the described processing temperatures are also useful. A flexible support is generally most useful.

The photothermographic compositions are coated on a support by coating procedures known in the photographic art including dip coating, airknife coating, curtain coating or extrusion coating using hoppers. If desired, two or more layers are coated simultaneously.

The described silver halide and oxidation-reduction image-forming combination are in any suitable location in the photothermographic element according to the invention which produces the desired image. In some cases it is desirable to include certain percentages of the described reducing agent, the silver salt oxidizing agent and/or other addenda in a protective layer or overcoat layer over the layer containing the other components of the element as described. The components, however, must be in a location which enables their desired interaction upon processing.

It is necessary that the photosensitive silver halide, as described, and other components of the imaging combination be "in reactive association" with each other in order to produce the desired image. The term "in reactive association," as employed herein, is intended to mean that the photosensitive silver halide and the image-forming combination are in a location with respect to each other which enables the desired processing and which produces a useful image.

A highly preferred embodiment of the invention is a photothermographic silver halide composition capable of being coated on a support comprising (a) an aqueous photosensitive silver halide emulsion containing at least 50% of the photosensitive silver halide as thin tabular silver halide grains having an average thickness of less than 0.3 microns in a gelatino peptizer with (b) an organic solvent mixture comprising a combination of a benzyl alcohol photographic speed-increasing solvent, such an unsubstituted benzyl alcohol, with toluene and up to 10% by weight poly(vinyl butyral), (c) a hydrophobic polymeric binder consisting essentially of poly(vinyl butyral) and (d) an oxidation-reduction image-forming combination comprising (i) a silver salt of a long-chain fatty acid consisting essentially of silver behenate with (ii) an organic reducing agent for the silver salt of a long-chain fatty acid, preferably consisting essentially of a sulfonamidophenol reducing agent. This composition can be coated on a suitable support to produce a photothermographic element according to the invention. Another embodiment of the invention is a method of preparing a photothermographic element comprising coating the resulting composition onto a support to produce a photothermographic element as desired.

A variety of imagewise exposure means are useful with the photothermographic materials according to the invention. The imaging means according to the invention is any suitable source of radiation to which the photothermographic material is sensitive. The imaging materials according to the invention are generally sensitive to the ultraviolet and blue regions of the spectrum and exposure means which provide this radiation are preferred. In a spectral sensitizing dye or combination of spectral sensitizing dyes are present in the photothermographic material, exposure means using other ranges of the electromagnetic spectrum can be useful. A photothermographic material according to the invention generally is exposed imagewise with a visible light source, such as a tungsten lamp. Other sources of radiation can be useful and include, for instance, lasers, electron beams, X-ray sources and the like. The photothermographic materials are generally exposed imagewise to produce a developable latent image.

A visible image is developed in the photothermographic material according to the invention within a short time, such as within several seconds, merely by heating the photothermographic material to moderately elevated temperatures. For example, the exposed photothermographic material is heated to a temperature within the range of about 90° C. to about 180° C., such as a temperature within the range of about 100° C. to about 140° C. Heating is carried out until a desired image is developed, typically within about 2 to about 3 seconds, such as about 2 to about 10 seconds. Selection of an optimum processing time and temperature depends upon such factors as the desired image, particular components of the photothermographic element, the particular latent image.

A variety of means are useful to produce the necessary heating of the described photothermographic material to develop the desired image. The heating means can be a simple hot plate, heated drum, iron, roller, infrared heating means, hot air heating means or the like.

Processing according to the invention is generally carried out under ambient conditions of pressure and humidity. Pressures and humidity outside normal atmospheric conditions can be useful if desired; however, normal atmospheric conditions are preferred.

The following examples are included for a further understanding of the invention.

EXAMPLE 1

This illustrates the invention.

A silver behenate dispersion (Dispersion I) was prepared by thoroughly blending the following components:

| Component | Concentration (in kilograms) |
|---|---|
| acetone (solvent) | 18.25 |
| toluene (solvent) | 19.66 |
| poly(vinyl butyral) (binder) | 2.76 |
| behenic acid (antifoggant) | 1.46 |
| alumina (development modifier) | 0.41 |
| silver behenate (oxidizing agent) | 3.89 |

A photographic silver halide emulsion was prepared as described above for Emulsion A. The gelatino silver bromoiodide emulsion contained silver bromoidide emulsion wherein about 75% of the projected area of the silver bromoiodide grains is provided by thin tabular grain silver bromoiodide (3 mole % iodide, chemically unsensitized). The thin tabular silver bromoiodide grains had an average thickness of 0.04 microns and an average diameter of 0.37 microns. The emulsion contained 15 grams of gelatin per silver mole, had a pH of 6.1, a pAg of 8.3, and a silver mole weight of 519 grams.

A 0.023 mole aliquot of the silver bromoiodide emulsion, at 40° C., was mixed with 0.1 ml of an aqueous H. T. Proteolytic 200 enzyme solution (5 mg/ml) (H.T. Proteolytic 200 enzyme is available from Miles Laboratories, Inc., Elkart, Ind., U.S.A.). After holding at 40° C. for 15 minutes, the resulting silver halide emulsion was treated with ultrasonic waves for six minutes in the presence of a solvent mixture containing 60 grams of toluene, 4 grams of benzyl alcohol and 5% by weight of poly(vinyl butyral). The resulting compositions was designated Emulsion B.

A photothermographic composition was prepared as follows:

The following components were mixed:

| | Amount |
|---|---|
| 11% by weight poly(vinyl butyral) (binder) | 5 g |
| toluene (solvent) | 10 g |
| blue-green sensitizing dye: 3-ethyl-5-(3-ethyl-2-benzoxazolylidene-ethylidene)-1-phenyl-2-thiohydantoin (0.7 mg of dye in 0.7 ml benzyl alcohol/toluene) (1:4 parts by volume) | 0.7 ml |
| 3-decyl-2-thia-2,4-oxazolidinedione (2 mg. in 1 ml benzyl alcohol/toluene) (1:9 parts by volume) (contrast modifier) | 1 ml |
| silver behenate dispersion. (Dispersion I as described above) | 75 g |

-continued

| | Amount |
|---|---|
| (oxidizing agent) | |

The resulting composition was dispersed by thoroughly skaking. Then the following was added:

| | |
|---|---|
| photosensitive silver bromoiodide emulsion (Emulsion B as described above) | 25 g |

The resulting composition was dispersed by thoroughly shaking. Then the following were added:

| | |
|---|---|
| red spectral sensitizing dye (anhydro-3-ethyl-9-methyl-3'-(3-sulfobutyl)-thiacarbocyanine hydroxide) ((1 mg in 1 ml benzyl alcohol/toluene (1:4 parts by volume)) | 1 ml |
| 2,6-dichloro-4-benzenesulfonamidophenol (2.25 g in 9 ml acetone/toluene (4.3 g: 9.2 g by weight) (reducing agent) | 9 ml |
| 2-(tribromomethylsulfonyl) benzothiazole ((0.5 g in 10 ml acetone/toluene (7.8 g:8.6 g by weight)) | 10 ml |
| toluene (solvent) to make a final weight of | 135 g |

The resulting photothermographic composition according to the invention was dispersed by shaking. The resulting photothermographic composition was coated at 12 ml per $ft^2$ (129 ml per $m^2$) on an unsubbed poly(ethylene terephalate) film support. The film support contained a blue antihalation dye. The resulting photothermographic layer was permitted to dry and then overcoated with a cellulose acetate protective layer.

The photothermographic element was imagewise exposed for $10^{-3}$ seconds to a Xenon light source through a 0.3 log E increment density step wedge with Wratten filters (Wratten is a trademark of Eastman Kodak Co., Rochester, N.Y., U.S.A.): W36 plus W38A, W9 and W23 to provide blue, minus blue and red exposures respectively. The resulting latent image in the photothermographic element was developed by heating the photothermographic element on a curved shoe at 115° C. for five seconds. The developed image for the blue exposure had a maximum density of 1.51. With minus blue and red exposures the relative log E (relative speed) of the developed images were significantly higher compared to control comparative photothermographic elements which were the same photothermographic elements with the exception that a conventional cubic grain photosensitive silver bromoiodide emulsion having an average grain size respectively of 0.06 micron, 0.08 micron, 0.12 micron and 0.18 micron were used in place of the thin tabular grain photosensitive silver bromoiodide. This is illustrated in the following Table I:

TABLE I

| AgBr I grain size (microns) | Relative Log E | |
|---|---|---|
| | Minus Blue exposure | Red exposure |
| 0.06 (Control A) | 1.2 | 0 |
| 0.08 (Control B) | 1.5 | 0 |
| 0.12 (Control C) | 1.8 | 0 |
| 0.18 (Control D) | 1.8 | 0 |

TABLE I-continued

| AgBr I grain size (microns) | Relative Log E | |
|---|---|---|
| | Minus Blue exposure | Red exposure |
| (invention) thin tabular grain 0.37 microns wide × 0.04 microns thick | 2 4 | 1.5 |

The data in Table I illustrates that a photothermographic element of the invention containing thin tabular grain photosensitive silver bromoiodide is more effectively spectrally sensitized resulting in a speed advantage compared to the control photothermographic elements.

EXAMPLE 2

The following comparative examples 2A through 2D in Table II were prepared by repeating controls A through D from Example 1:

TABLE II

| Increase in Intrinsic (Blue) Speed | |
|---|---|
| Example No. | Intrisic Blue Speed* (Rel. Log E) |
| 2A (comparison) | 0 |
| 2B (comparison) | 0 |
| 2C (comparison) | 0.6 |
| 2D (comparison) | 0.6 |
| 1 (invention) | 0.9 |

*measured as in Example 1

Examples 2A through 2D compared to Example 1 demonstrate that the photothermographic material of Example 1 provides increased blue speed compared to the comparative photothermographic materials. This increased speed was observed for both photothermographic materials that were spectrally sensitized and photothermographic materials not spectrally sensitized.

In each case the image developed in Example 1 had a higher value indicating a more neutral (black) image tone than any of the images developed in the Comparative Examples. The more neutral (black) image tone was also confirmed by visual observation with the unaided eye.

EXAMPLE 3

This is a comparative example.

The following comparative Examples 3A through 3D in Table III were prepared by repeating controls A through D from Example 1.

The development efficiency of the photothermographic material of Example 1 was measured in comparison to the photothermographic materials of comparative Examples 3A through 3D. The concentration of silver developed compared to the concentration of silver coated prior to exposure was measured. This is given in the following Table III:

TABLE III

| Example No. | Area/ Grain ($\mu M^2$) | Surface Area/ mole Ag° ($M^2$) | Development Efficiency (Ag° Dev/ Ag° Ctd.) |
|---|---|---|---|
| 3A (comparison) | 0.0216 | 2900 | 24.6% |
| 3B (comparison) | 0.0384 | 2200 | 18.6–20.2% |
| 3C (comparison) | 0.0864 | 1450 | 8.32–9.23% |
| 3D (comparison) | 0.1944 | 967 | 1.77–4.89% |

TABLE III-continued

| Example No. | Area/ Grain ($\mu M^2$) | Surface Area/ mole Ag° ($M^2$) | Development Efficiency (Ag° Dev/ Ag° Ctd.) |
|---|---|---|---|
| 1 | 0.2610 | 1760 | 22.2–26.7% |

The results in Table III illustrate that, while development efficiency decreases with increasing grain area for the photothermographic materials (Examples 3A through 3D) containing cubic grain silver halide, the development efficiency for the photothermographic material of Example 1 was increased compared to the photothermographic material of Example 3D which had the largest area per grain. This development efficiency was also confirmed by observation of electron micrographs taken from the maximum density areas of each exposed and processed photothermographic material.

The invention has been described in detail with particular reference to preferred embodiments thereof, but it will be understood that variations and modifications can be effected within the spirit and scope of the invention.

What is claimed is:

1. In a photothermographic element comprising a support bearing in reactive association, photosensitive silver halide grains and a photosensitive silver halide processing agent, the improvement wherein;

at least 50% of the projected area of the photosensitive silver halide grains is provided by thin tabular grains having an average grain thickness of less than 0.3 microns.

2. A photothermographic element as in claim 1 wherein said photosensitive silver halide grains are thin tabular grains having an average grain thickness within the range of about 0.03 to about 0.08 microns.

3. A photothermographic element as in claim 1 wherein said photosensitive silver halide grains are thin tabular grains having an average grain thickness within the range of about 0.03 to about 0.08 microns and an average aspect ratio within the range of 5:1 to 15:1.

4. A photothermographic element as in claim 1 wherein at least 70% of said photosensitive silver halide grains are thin tabular grains having an average grain diameter within the range of about 0.30 to about 0.345 $\mu$m, an average grain thickness within the range of about 0.04 to about 0.05 microns and an average aspect ratio within the range of 5:1 to 15:1.

5. A photothermographic element as in claim 1 wherein said photosensitive silver halide is a silver bromoiodide or silver halide.

6. A photothermographic element as in claim 1 wherein said thin tabular grains are spectrally sensitized.

7. A photothermographic element as in claim 1 wherein said thin tabular grains are spectrally sensitized to the red region of the electromagnetic spectrum.

8. A photothermographic element as in claim 1 comprising a gelatino photographic silver halide emulsion.

9. A photothermographic element as in claim 1 comprising a binder.

10. A photothermographic element as in claim 1 comprising a poly(vinyl butyral) binder.

11. A photothermographic element as in claim 1 wherein said photographic silver halide processing agent comprises a silver halide developing agent.

12. In a photothermographic element comprising a support bearing, in reactive association, (a) photosensitive silver halide grains and (b) an image forming combination comprising (i) an organic heavy metal salt oxidizing agent with (ii) a reducing agent for the organic heavy metal salt oxidizing agent, the improvement wherein;

at least 50% of the projected area of the photosensitive silver halide grains is provided by thin tabular grains having an average grain thickness of less than 0.3 microns.

13. A photothermographic element as in claim 12 wherein said photosensitive silver halide grains are thin tabular grains having an average thickness within the range of about 0.03 to about 0.08 microns.

14. A photothermographic element as in claim 12 wherein said photosensitive silver halide grains are thin tabular grains having an average grain thickness within the range of about 0.03 to about 0.08 microns and an aspect ratio within the range of 5:1 and 15:1.

15. A photothermographic element as in claim 12 wherein at least 70% of said photosensitive silver halide grains are thin tabular grains having an average grain diameter within the range of about 0.30 to about 0.45 $\mu$m, an average grain thickness within the range of about 0.04 to about 0.05 microns and an average aspect ratio within the range of 5:1 to 15:1.

16. A photothermographic element as in claim 12 wherein said photosensitive silver halide is a silver bromoiodide or silver bromide.

17. A photothermographic element as in claim 12 wherein said thin tabular grains are spectrally sensitized.

18. A photothermographic element as in claim 12 wherein said thin tabular grains are spectrally sensitized to the red region of the electromagnetic spectrum.

19. A photothermographic element as in claim 12 comprising a gelatino photographic silver halide emulsion.

20. A photothermographic element as in claim 12 wherein said image forming combination comprises (i) an organic heavy metal salt oxidizing agent which is a silver salt of a long chain fatty acid with (ii) a reducing agent for the organic heavy metal salt oxidizing agent wherein the reducing agent comprises a phenolic reducing agent.

21. A photothermographic element as in claim 12 comprising a binder.

22. A photothermographic element as in claim 12 comprising a poly(vinyl butyral) binder.

23. In a photothermographic element comprising a support bearing, in reactive association, in a poly(vinyl butyral) binder, (a) photosensitive silver halide grains and (b) and image forming combination comprising (i) an organic silver salt oxidizing agent comprising silver behenate with (ii) a phenolic reducing agent for the organic silver salt oxidizing agent, the improvement wherein;

at least 70% of the projected area of the photographic silver halide grains is provided by thin tabular grains having an average grain diameter within the range of about 0.30 to about 0.45 $\mu$m, an average grain thickness within the range of about 0.04 to about 0.05 microns and an average aspect ratio within the range of 5:1 to 15:1.

24. In a photothermographic composition comprising photosensitive silver halide grains and a photographic silver halide processing agent, the improvement wherein, at least 50% of the projected area of the photosensitive silver halide grains is provided by thin tabular grains having an average grain thickness of less than 0.3 microns.

25. A photothermographic composition as in claim 24 wherein said photosensitive silver halide grains are thin tabular grains having an average grain thickness within the range of about 0.03 to about 0.08 microns.

26. A photothermographic composition as in claim 24 wherein said photosensitive silver halide grains are thin tabular grains having an average grain thickness within the range of about 0.03 to about 0.08 microns and an average aspect ratio within the range of 5:1 to 15:1.

27. A photothermographic composition as in claim 24 wherein at least 70% of the projected area of the photosensitive silver halide grains is provided by thin tabular grains having an average grain diameter within the range of about 0.30 to about 0.45 μm, an average grain thickness within the range of about 0.04 to about 0.05 microns and an average aspect ratio within the range of 5:1 to 15:1.

28. A photothermographic composition as in claim 24 wherein said photosensitive silver halide is a silver bromoiodide or silver bromide.

29. A photothermographic composition as in claim 24 wherein said thin tabular grains are spectrally sensitized.

30. A photothermographic composition as in claim 24 wherein said thin tabular grains are spectrally sensitized to the red region of the electromagnetic spectrum.

31. A photothermographic composition as in claim 24 comprising a gelatino photographic silver halide emulsion.

32. A photothermographic composition as in claim 24 comprising a binder.

33. A photothermographic composition as in claim 24 comprising a ply(vinyl butyral) binder.

34. A photothermographic composition as in claim 24 wherein said photographic silver halide processing agent comprises a silver halide developing agent.

35. In a photothermographic composition comprising (a) photosensitive silver halide grains and (b) an image forming combination comprising (i) an organic heavy metal salt oxidizing agent with (ii) a reducing agent for the organic heavy metal salt oxidizing agent, the improvement wherein;

at least 50% of the projected area of the phototsensitive silver halide grains is provided by thin tabular grains having an average grain thickness of less than 0.3 microns.

36. A photothermographic composition as in claim 35 wherein said photosensitive silver halide grains are thin tabular grains having an average grain thickness within the range of about 0.03 to about 0.08 microns.

37. A photothermographic composition as in claim 35 wherein said photosensitive silver halide grains are thin tabular grains having an average grain thickness within the range of about 0.03 to about 0.08 microns and an average aspect ratio within the range of 5:1 to 15:1.

38. A photothermographic composition as in claim 35 wherein at least 70% of the projected area of the photosensitive silver halide grains is provided by thin tabular grains having an average grain diameter within the range of about 0.30 to about 0.45 μm, an average thickness within the range of about 0.04 to about 0.05 micron and an average aspect ratio within the range of 5:1 to 15:1.

39. A photothermographic composition as in claim 35 wherein said photosensitive silver halide is a silver bromoiodide or silver bromide.

40. A photothermographic composition as in claim 35 wherein said thin tabular grains are spectrally sensitized.

41. A photothermographic composition as in claim 35 wherein said thin tabular grains are spectrally sensitized to the red region of the electromagnetic spectrum.

42. A photothermographic composition as in claim 35 comprising a gelatino photographic silver halide emulsion.

43. A photothermographic composition as in claim 35 wherein said image forming combination comprises (i) an organic heavy metal salt oxidizing agent which is a silver salt of a long chain fatty acid with (ii) a reducing agent for the organic heavy metal salt oxidizing agent wherein the reducing agent comprises a phenolic reducing agent.

44. A photothermographic composition as in claim 35 also comprising a binder.

45. A photothermographic composition as in claim 35 also comprising a poly(vinyl butyral) binder.

46. In a photothermographic composition comprising, in a poly(vinyl butyral) binder, (a) photosensitive silver halide grains and (b) an image forming combination comprising (i) an organic silver salt oxidizing agent comprising silver behenate with (ii) a phenolic reducing agent for the organic silver salt oxidizing agent, the improvement wherein, at least 70% of the projected area of the photographic silver halide grains is provided by thin tabular grains having an average grain diameter within the range of about 0.30 to about 0.45 μm, an average grain thickness within the range of about 0.04 to about 0.05 microns and an aspect ratio within the range of 5:1 to 15:1.

47. A process of developing an image in an exposed photothermographic element comprising a support bearing, in reactive association, (a) photosensitive silver halide grains wherein at least 50% of the projected area of the photosensitive silver halide grains is provided by thin tabular grains having an average grain thickness of less than 0.3 microns, and (b) a photosensitive silver halide processing agent, said process comprising;

heating said element to a temperature within the range of about 90° C. to about 180° C. until said image is developed.

48. A process of developing an image in an exposed photothermographic element comprising a support bearing, in reactive association, (a) photosensitive silver halide grains wherein at least 50% of the projected area of the photosensitive silver halide grains is provided by thin tabular grains having an average grain thickness of less than 0.3 microns, and (b) an image forming combination comprising (i) an organic heavy metal salt oxidizing agent with (ii) a reducing agent for the organic heavy metal salt oxidizing agent, said process comprising;

heating said element to a temperature within the range of about 90° C. to about 180° C. until said image is developed.

49. A process of developing an image in an exposed photothermographic element comprising a support bearing, in reactive association, in a poly(vinyl butyral) binder, (a) photosensitive silver halide grains wherein at least 70% of the projected area of the silver halide grains is provided by thin tabular grains having an average grain diameter within the range of about 0.30 to about 0.45 μm, an average grain thickness within the range of about 0.04 to about 0.05 microns and an average aspect ratio within the range of 5:1 to 15:1; and (b) an image forming combination comprising (i) an organic silver salt oxidizing agent comprising silver behenate with (ii) a phenolic reducing agent for the organic silver salt oxidizing agent, said process comprising;

heating said element to a temperature within the range of about 90° C. to about 180° C. until said image is developed.

* * * * *

UNITED STATES PATENT AND TRADEMARK OFFICE

CERTIFICATE OF CORRECTION

PATENT NO. 4,435,499
DATED March 6, 1984
INVENTOR(S) John W. Reeves

It is certified that error appears in the above-identified patent and that said Letters Patent are hereby corrected as shown below Col. 9, line 43, "tubular" should read --tabular--.

Col. 10, line 48-49, "2thiohydantoin" should read --2-thiohydantoin--.

Col. 10, line 49-50, "1-isoxazolin-5-one" should read --2-isoxazolin-5-one--.

Col. 15, line 28, "gelatin which is very useful is" should read --gelatin is preferred. The concentration of gelatin--.

Col. 19, line 57, "3" should read --30--.

Col. 21, line 7, "skaking" should read --shaking--.

Col. 22, line 7, "24" should read --2.4--.

Col. 23, line 47, "0.345" should read --0.45--.

Col. 23, line 53, "halide" should read --bromide--.

UNITED STATES PATENT AND TRADEMARK OFFICE

CERTIFICATE OF CORRECTION

PATENT NO. 4,435,499
DATED March 6, 1984
INVENTOR(S) John W. Reeves

It is certified that error appears in the above-identified patent and that said Letters Patent are hereby corrected as shown below Col. 24, line 21, "and" should read --to--.

Col. 24, line 55, "(b) and" should read --(b) an--.

Col. 25, line 40, "ply" should read --poly--.

Signed and Sealed this

*Fifth* Day of *March 1985*

[SEAL]

*Attest:*

DONALD J. QUIGG

*Attesting Officer* *Acting Commissioner of Patents and Trademarks*